United States Patent [19]

Izdebski

[11] 4,290,331

[45] Sep. 22, 1981

[54] PICK-UP FOR A MUSICAL INSTRUMENT

[76] Inventor: Jerzy Izdebski, 77, Brondesbury Rd., London, N.W.6.,, England

[21] Appl. No.: 61,188

[22] Filed: Jul. 27, 1979

[51] Int. Cl.[3] ..... G10H 3/00

[52] U.S. Cl. ..... 84/1.14; 84/DIG. 24; 84/1.16

[58] Field of Search ..... 84/1.14, DIG. 24, 1.16; 310/326, 328, 338, 345

[56] References Cited

U.S. PATENT DOCUMENTS

| | | | |
|---|---|---|---|
| 1,669,170 | 5/1928 | Nicolson | 310/326 |
| 3,031,591 | 4/1962 | Cary et al. | 310/338 |
| 4,084,473 | 4/1978 | Kitashima et al. | 84/1.14 |
| 4,160,401 | 7/1979 | Tomioka | 84/DIG. 24 |

*Primary Examiner*—J. V. Truhe
*Assistant Examiner*—Forester W. Isen
*Attorney, Agent, or Firm*—Wigman & Cohen

[57] ABSTRACT

An acoustic pick-up for a musical instrument comprises a piezo-electric crystal mounted in a housing. Coupling means, such as a wooden post, is provided for coupling one face of the crystal to a part of the musical instrument with the housing mounted on the instrument. There is further provided means, such as a screw, for varying the pressure with which the crystal is coupled to the part of the instrument by applying an adjustable force to another face of the crystal.

10 Claims, 3 Drawing Figures

PICK-UP FOR A MUSICAL INSTRUMENT

BACKGROUND OF THE INVENTION

1. Field of the Invention

This invention relates to a pick-up for a musical instrument.

2. Description of Prior Art

The pick-ups in general use, such as guitar pick-ups, are usually in the form of a series of magnetic cores surrounded by pick-up coils lying beneath the respective strings of the guitar. Such pick-ups are of course only of such with metal strings and they tend to give a rather metallic sound often associated with an electric guitar. Microphones have been proposed for use with acoustic guitars, but they have the disadvantage that too much background noise can be picked up which again tends to produce a rather poor quality sound.

SUMMARY OF THE INVENTION

According to the present invention there is provided a pick-up for a musical instrument comprising a piezo-electric crystal mounted in a housing, coupling means arranged to couple one face of the crystal to a part of musical instrument when the housing is mounted on the instrument, and means arranged, when the housing is mounted on the instrument, to adjust the pressure with which the crystal is coupled to said part by applying an adjustable force to another face of the crystal.

Preferably the coupling means is a wooden post. The pressure means is preferably a screw. Conveniently the housing may be glued, in use, to the bridge of a guitar.

BRIEF DESCRIPTION OF THE DRAWINGS

The invention will now be described in more detail, by way of example only, with reference to the accompanying drawings, in which.

DESCRIPTION OF THE PREFERRED EMBODIMENT

Figure 1:
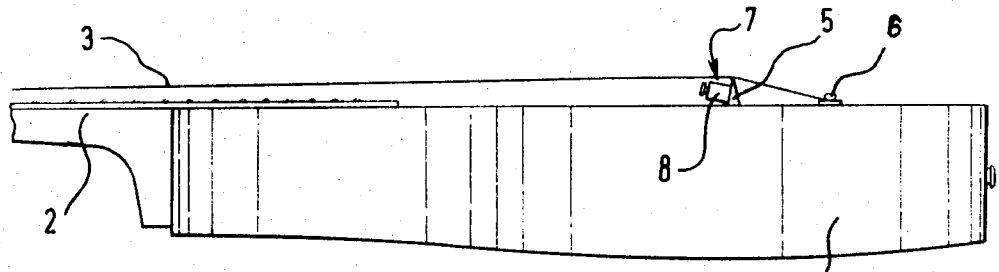
FIG. 1 is a diagrammatic longitudinal sectional view of the sound box of a guitar.
Figure 2:
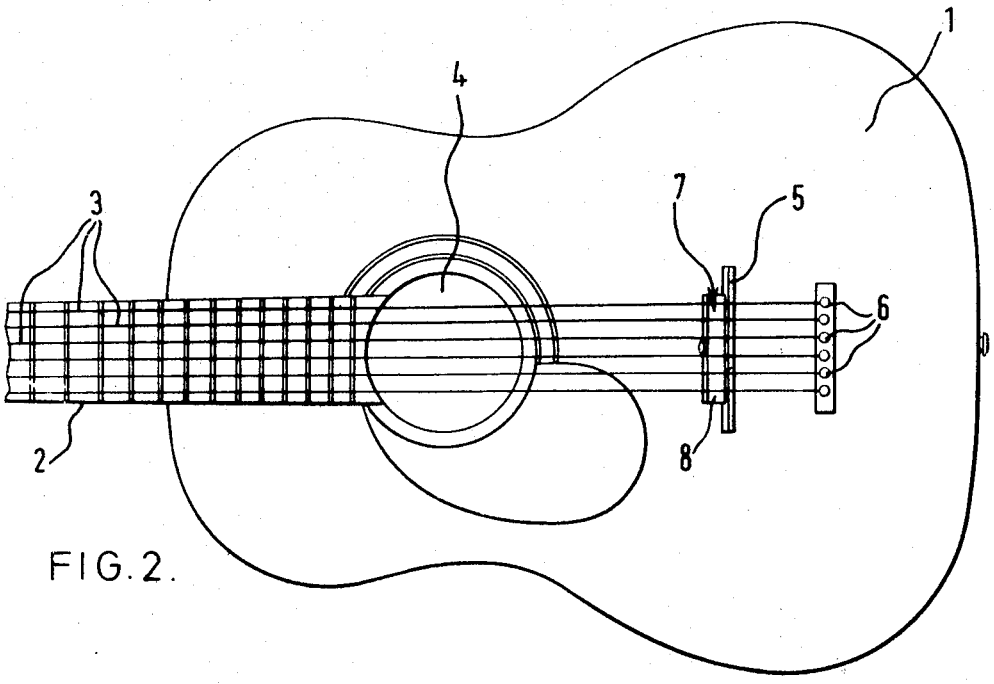
FIG. 2 is a plan view of the guitar shown in FIG. 1.

The guitar shown in FIGS. 1 and 2 comprises a sound box 1 provided with an aperture 4, a neck 2 and six strings 3. The strings 3 are spaced from the sound box 4 by a bridge 5 and attached to the sound box 1 by means of pegs 6.

Figure 3:
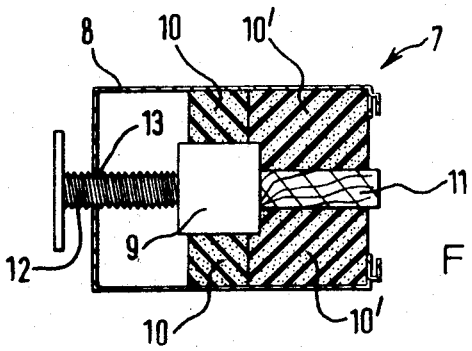
FIG. 3 is a diagrammatic sectional view of a pick-up in accordance with the invention.

A pick-up generally reference 7 has a housing 8 glued to the bridge 5 beneath the strings 3. The pick-up 7, which is shown in more detail in FIG. 3, includes a piezo-electric crystal 9 which is mounted in a foam rubber mounting 10. An additional foam block 10' is also provided to bias the crystal 9 away from the bridge 5 so that when a screw 12 is unscrewed a wooden post 11 glued to the crystal 9 tends to move away from the bridge 5. The piezo-electric crystal 9 is glued on one face to the wooden post 11 of which the free end, in use, contacts the bridge 5 of the guitar. The screw 12 passes through a threaded aperture 13 in the housing and bears against a face of the crystal 9 remote from that carrying the post 11. By rotating the screw 12, the pressure with which the crystal 9 is applied to the bridge 5 through the post 11 can be varied. The crystal 9 also includes a pair of electrodes (not shown) coupled to leads for carrying an electrical signal representative of the vibrations of the piezo-electric crystal 9. The leads may be connected to the input of an amplifier in the conventional manner.

In operation, the leads from the piezo-electric crystal 9 are connected to the input of the amplifier. The housing 8 is glued to the bridge 5 and the screw 12 is rotated to vary the pressure on the crystal 9. It is found that the quality of the sound produced by the amplifier can be substantially altered by varying the pressure on the crystal 9, and in practice the optimum setting of the screw 12 can be found by experiment.

The post 11 would normally be of wood, although other materials through which sound waves readily travel could be used.

The pick-up may be used with other musical instruments such as violins for example.

I claim:

1. A pick-up adapted to be readily added-on to a musical instrument comprising a piezo-electric crystal having first and second faces, a housing surrounding said piezo-electric crystal and including top and bottom surfaces, pressure varying means extending through said top surface of said housing, said piezo-electric crystal being mounted in said housing by a resilient member, wooden coupling means for vibrationally coupling said first face of said piezo-electric crystal to a part of a musical instrument when said housing bottom surface is mounted on the musical instrument, said pressure varying means adjusting the pressure with which said piezo-electric crystal is coupled to the part, when said housing is mounted on the musical instrument, by applying an adjustable force to said second face of said piezo-electric crystal.

2. A pick-up as set forth in claim 1, wherein said coupling means is a post.

3. A pick-up as set forth in claim 1, wherein said pressure varying means is a screw.

4. A pick-up as set forth in claim 1, wherein said piezo-electric crystal is mounted in said housing by a foam rubber support.

5. A pick-up as set forth in claim 1, further including biasing means located between said second face of said piezo-electric crystal and said housing bottom surface to bias said crystal away from said housing surface.

6. A pick-up as set forth in claim 5, wherein said biasing means is made of foam rubber.

7. A transducer for mounting on the bridge of a stringed musical instrument to convert vibration in said bridge into a corresponding electrical signal, said transducer comprising a piezo-electric crystal having first and second faces, a housing, wooden coupling means, and pressure varying means, said piezo-electric crystal being mounted in said housing, said wooden coupling means vibrationally coupling said first face of said piezo-electric crystal to said bridge of said musical instrument when said housing is mounted on said bridge of said musical instrument, said pressure varying means adjusting the pressure with which said piezo-electric crystal is coupled to said bridge of said musical instrument by applying an adjustable force to said second surface of said piezo-electric crystal.

8. A transducer as set forth in claim 7, wherein said coupling means comprises a post having a first end face in contact with said first face of said piezo-electric crystal and a second end face in contact with said bridge of said musical instrument whereby sound waves are transmitted therethrough.

9. A transducer as set forth in claim 7, wherein said pressure varying means is a screw retained in a threaded aperture defined by said housing, said screw having a first end within said housing in contact with a portion of said second face of said piezo-electric crystal and a second end disposed outside said housing and provided with a knob, whereby said adjustable force applied to said second face of said piezo-electric crystal can be readily adjusted by hand.

10. A transducer as set forth in claim 9, wherein foam rubber is disposed between said first face of said piezo-electric crystal and a part of said housing in contact with said bridge so as to provide resilient mounting of said piezo-electric crystal and a return force against which said pressure varying screw operates.

* * * * *